US006055690A

United States Patent [19]

Koenig

[11] Patent Number: 6,055,690

[45] Date of Patent: May 2, 2000

[54] SLEEPING PAD, BEDDINGS AND BUMPERS TO IMPROVE RESPIRATORY EFFICIENCY AND ENVIRONMENTAL TEMPERATURE OF AN INFANT AND REDUCE THE RISKS OF SUDDEN INFANT DEATH SYNDROME (SIDS) AND ASPHYXIATION

[76] Inventor: J. Frank Koenig, 407 Kramer Dr. SE., Vienna, Va. 22180

[ * ] Notice: Under 35 U.S.C. 154(b), the term of this patent shall be extended for 354 days.

[21] Appl. No.: 08/551,319

[22] Filed: Nov. 1, 1995

[51] Int. Cl.[7] ..... A47C 27/14; A47C 21/04; A47D 7/00

[52] U.S. Cl. ..... 5/724; 5/93.1; 5/424; 5/740; 5/652.1; 5/953; 5/425

[58] Field of Search ..... 5/93.1, 424, 425, 5/461, 468

[56] References Cited

U.S. PATENT DOCUMENTS

| | | | |
|---|---|---|---|
| 2,128,978 | 9/1938 | Akin | 5/93.1 |
| 2,203,921 | 6/1940 | Padjen | 5/93.1 X |
| 3,430,272 | 3/1969 | Thorn, Jr. | 5/93.1 |
| 4,809,374 | 3/1989 | Saviez | 5/420 |
| 4,825,488 | 5/1989 | Bedford | 5/726 |
| 4,890,346 | 1/1990 | Rist | 5/427 X |

*Primary Examiner*—Terry Lee Melius
*Assistant Examiner*—Robert G. Santos
*Attorney, Agent, or Firm*—Shlesinger Arkwright & Garvey, LLP

[57] ABSTRACT

Rebreathing carbon dioxide and overheating of the infant are contributing causes of Sudden Infant Death Syndrome (SIDS) and asphyxiation. The characteristics of conventional crib mattresses, beddings and bumper pads contribute to rebreathing of carbon dioxide and overheating of the infant and may be contributing environmental causes of SIDS, asphyxiation, apnea syndromes and hypoventilation. The present invention consists of improved sleeping pads, beddings and bumper pads which reduce rebreathing of carbon dioxide and overheating and provide increased crib ventilation to stimulate breathing.

17 Claims, 6 Drawing Sheets

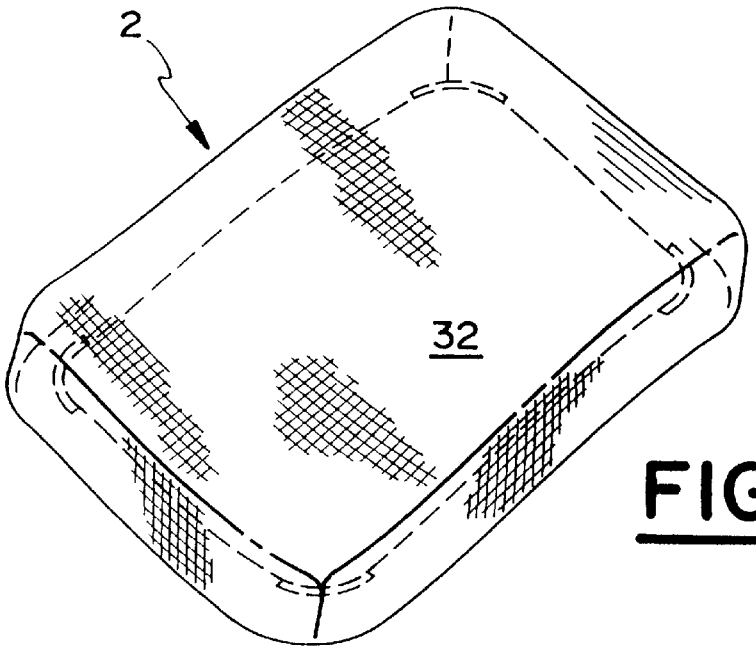
FIG. 12
FIG. 13
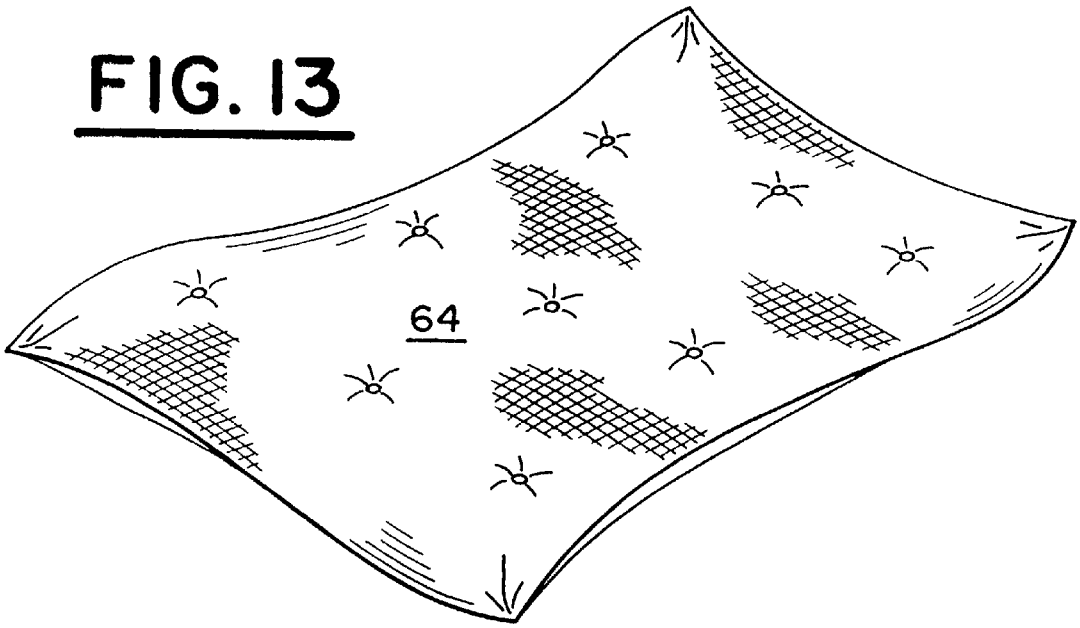

SLEEPING PAD, BEDDINGS AND BUMPERS TO IMPROVE RESPIRATORY EFFICIENCY AND ENVIRONMENTAL TEMPERATURE OF AN INFANT AND REDUCE THE RISKS OF SUDDEN INFANT DEATH SYNDROME (SIDS) AND ASPHYXIATION

FIELD OF THE INVENTION

The present invention relates to apparatus for reducing the risk of sudden infant death syndrome, asphyxiation, apnea syndrome and hypoventilation through the use of improved sleeping pads, beddings and bumper pads within a crib or the like to improve the respiratory efficiency and environmental temperature of an infant.

BACKGROUND OF THE INVENTION

Sudden infant death syndrome (SIDS) is the leading cause of postneonatal infant death in the United States. About 7,000 deaths occur each year from SIDS. In addition, many infants die each year of asphyxiation while in a crib.

SIDS is defined as the sudden death of an infant under 1 year of age that remains unexplained after a thorough case investigation, including performance of a complete autopsy, examination of the death scene, and review of the clinical history.

Prone sleeping is associated with spontaneous face-down sleeping in infants. The face-down position is associated with rebreathing expired gases, including carbon dioxide, and increased carbon dioxide lung pressure in normal infants. In some cases the amount of rebreathed carbon dioxide is sufficient to cause death in normal infants. B. A. Chiodini and B. T. Thach, *Impaired ventilation in infants sleeping facedown: Potential significance for sudden infant death syndrome,* J. Pediatrics, Vol. 123, 686 (1993); J. S. Kemp and B. T. Thach, *Sudden Death in Infants Sleeping on Polystyrene-Filled Cushions,* New England Journal of Medicine, Vol. 324, 1858 (1991). In that case the cause of death is asphyxiation, not SIDS. However in SIDS's cases the rebreathing of carbon dioxide, short of asphyxiation, may be a contributing cause of death of the infant.

A brain defect has been discovered that may be the cause of some cases of SIDS. H. C. Kinney, J. J. Filiano, L. A. Sleeper, F. Mandell, M. Valdes-Dapena, W. F. White, *Decreased Muscarinic Receptor Binding in the Arcuate Nucleus in Sudden Infant Death Syndrome,* Science, Vol. 269, 1446 (1995). That study suggests that a normal infant's nervous system detects progressive hypercarbia (excessive carbon dioxide in the blood) and asphyxia (stoppage of breathing) and responds by arousal and a series of protective reflexes to ensure airway patency whereas the SIDS infant having the defect does not perform these protective reflexes. The present invention compensates for this brain defect by continuously removing expired carbon dioxide from the crib and providing fresh room air to stimulate breathing. This compensation occurs for all facial positions including face-down.

Other studies have shown an association between excessive clothing and beddings and an increased rate of SIDS. W. G. Guntheroth, P. S. Spiers, *Sleeping Prone and the Risk of Sudden Infant Death Syndrome,* JAMA, Vol. 267, No. 17 (1992). It is believed that excessive clothing and bedding produces hyperthermia (overheating) within the infant.

The American Academy of Pediatrics recommends that an infant be placed on its back or side when sleeping because the incidence of SIDS is greatly reduced as compared to the prone position. American Academy of Pediatrics, *Positioning and SIDS,* Pediatrics, Vol. 89, No. 6 (1992). However, when the infant is three to four months old it is capable of rolling over to the prone position. The supine position is considered particularly unsafe for infants suffering from respiratory distress or excessive regurgitation after feeding.

Pediatricians recommend use of a firm mattress and the avoidance of unduly soft beddings. It is believed that such measures will prevent the infant from sinking into the mattress and beddings and thereby avoid restricting the availability of ventilation and oxygen.

Periodic breathing is a normal phenomenon in which an infant's breathing is interrupted by recurrent apneas (absences of breathing). It has been shown that an increase in ambient oxygen concentration reduces the incidence of apnea in infants. J. Kattwinkel, *Neonatal/Apnea: Pathogenesis and Therapy,* J. Pediatrics, Vol. 90, 342 (1977) ; T. Hoppen-Brouwers, J. E. Hodgman, R. M. Harper et al., *Polygraphic studies of normal infants during the first six months of life: I.V. Incidence of Apnea and Periodic Breathing,* Pediatrics, Vol. 60, No. 418 (1977); N. N. Finer, K. J. Barrington, B. Hayes, *Prolonged Periodic Breathing: Significance in Sleep Studies,* Pediatrics, Vol. 89, No. 3 (1992). Those sleeping infants who are not aroused by increases in oxygen level (hypoxic arousal) were determined to have a greater risk of SIDS. Perhaps excessive rebreathing of carbon dioxide has an anesthetic effect on the sleeping infant which can be overcome in most cases by increasing the ambient oxygen level.

While no specific cure of SIDS is known, the above studies as well as other medical research suggests that neurological disorders, sleeping in the prone position, rebreathing expired carbon dioxide and overheating may each be a contributing cause.

Since almost all cases of SIDS and asphyxiation occur in cribs, it is reasonable to investigate the characteristics of the crib system consisting of the infant, clothing, mattress, beddings and bumper pads in order to determine whether some of these system components, excluding the infant, are contributing environmental causes of SIDS and asphyxiation.

The U.S. Consumer Product Safety Commission (CPSC) has studied rebreathing of carbon dioxide using rabbits as well as a doll in combination with a mechanical lung. N. J. Scheers, *Infant Suffocation Project,* Final Report, U.S. Consumer Product Safety Commission, January, 1995. In those studies the amount of rebreathing of carbon dioxide was measured for a variety of infant bedding items. The test included death scene re-creations. It was found that expired carbon dioxide enters infant bedding and provides a "pool" of carbon dioxide for rebreathing. The results showed that rebreathing carbon dioxide trapped in soft bedding products may have contributed to the deaths of the estimated 30 percent of infants found in potentially suffocating circumstances. In addition, the CPSC recommended against use of decorator pillows or the like in the crib environment to further lessen the likelihood of suffocation.

Prior art devices for reducing the likelihood of SIDS usually focus on an infant's respiration and attempt to provide oxygen to the infant while removing expired carbon dioxide efficiently. In other words, they attempt to increase ventilation within the crib. It is known that conventional bedding is minimally gas permeable and causes "pooling" of potentially dangerous expired carbon dioxide within the beddings for rebreathing.

One such device is disclosed in U.S. Pat. No. 5,389,037 to Hale. The Hale apparatus includes an air plenum assembly, including an electric blower, attached to the crib to mechanically direct a flow of air toward the infant. Still another device is disclosed in U.S. Pat. No. 5,317,767 to Hargest et al. In that device, air is directly introduced into the crib environment through an air permeable mattress upon which the infant rests. Yet another device is disclosed in U.S. Pat. No. 5,305,483 to Watkins which describes a mattress pad whereby the pillow portion is provided with a pump and ventilation means to constantly pump air through numerous air pockets supplied within the pad.

Each of these devices is complex, requires an electric power source, is noisy and obtrusive and may be uncomfortable for the infant. Further, the Hargest and Watkins devices require supplemental supports positioned underneath their pads since the air permeable pads are neither rigid nor self-supporting. Hale's apparatus may be ineffective if the infant's nose and month are covered by the mattress and/or beddings so that air blown toward the infant has no effect on respiration.

A need has existed within the art for a sleeping pad that will provide passive ventilation of the crib without requiring pumps, fans or other potentially hazardous electrical devices. In addition, it is desirable to provide a sleeping pad that will sufficiently remove carbon dioxide and mucus or other fluid spit up by the child when sleeping thereby reducing the risks of SIDS and asphyxiation. Lastly, it is desirable to provide a sleeping pad, crib slat bumpers and gas and liquid transmissive bedding for use in a crib to enable: (a) expired respiratory gases to move away from the crib; (b) increase ventilation to the crib to reduce the risk of overheating and (c) supply sufficient oxygen to the crib to stimulate breathing.

OBJECTS AND SUMMARY OF THE INVENTION

It is therefore an object of the present invention to provide an apparatus for reducing the risks of Sudden Infant Death Syndrome and Asphyxiation, including the provision of a sleep pad for infants provided with passageways to enhance the availability of oxygen to the infant, including the face-down position, while at the same time passively removing carbon dioxide expired by the infant from the crib environment.

A still further object of the present invention is to provide a sleeping pad for an infant that is rigid enough to support the infant without the frame and support means required by prior art devices.

Yet another object of the invention is to provide a sleeping pad for an infant whereby the infant can comfortably rest on the pad without deformation of the passageways extending through the pad to thereby readily maintain transmission of respiratory gases therethrough.

Yet another object of the present invention is to provide a sleeping pad for infants having a grid-like configuration that will create a high surface area region for the transmission of respiratory gases.

Still a further object of the present invention is to provide a sleeping pad readily adapted to fit within a conventional crib and which can be used in conjunction with bumpers for the slats of a crib to provide safety against injury to the infant while also providing means to readily cause transmission of respiratory gases therethrough.

Another object of the present invention is to provide bumpers that prevent injury to the child in the event the child falls against the side walls of the crib.

Still a further object of the present invention is to provide crib slat bumpers that do not interfere with transmission of respiratory gases through the crib environment.

Another object of the present invention is to provide a sleeping pad and bumper for a crib constructed from materials that allow respiratory gases to pass therethrough while maintaining rigidity to the pad and bumper.

Another object of the present invention is to provide a sleeping pad adapted to be selectively covered with a mesh or open-weave covering while retaining passive respiratory gas transmission properties.

Another object of the present invention is to provide a sleeping pad and bumper arrangement for a crib that readily transmits carbon dioxide gases expired from the infant therethrough thereby keeping the entire environment of the crib free from potentially toxic gases.

Still a further object of the present invention is to provide a device that enables the passive transmission of respiratory gases into and out of the crib without the need for electrical devices, complex filter means, tubing, or other noise generating apparatus.

Still a further object of the present invention is to provide a mattress pad and bumpers for a crib that is readily adapted for use with different crib constructions.

It is another object of the present invention to reduce apnea and increase hypoxic arousal by decreasing hypoxia and hypercapnia (less than normal oxygen in organs and tissues) during the quiet sleep of infants.

There is yet a further object of the present invention to reduce the risk of an infant overheating within a crib or play area thereby falling victim to Sudden Infant Death Syndrome.

Yet another object of the present invention is to decrease the rebreathing of expired carbon dioxide near the month and nose of an infant.

Still a further object of the present invention is to prevent the formation of pockets of carbon dioxide which may be trapped within bedding surrounding an infant.

Still a further object of the present invention is to safely increase the breathing efficiency of an infant experiencing inadequate shallow end tidal volume of the lungs.

Another object of the present invention is to reduce respiratory abnormalities in infants and the incidence of crib death by providing a flow of room air to the sleeping infants environment to stimulate breathing in a passive manner by means of infant bedding including pads, bumpers and comforters.

These and other objects of the present invention are achieved by providing a sleeping pad for infants adapted to readily promote passive ventilation therethrough during use comprising a support member having a top, a bottom and sides, the support member adapted to resiliently support an infant thereon, a plurality of substantially planar, four sided passageways extending through the support member from the top to the bottom, each one of these sides is perpendicular to the top and the bottom and abuts against an adjacent one of the sides from the top to the bottom to readily transmit fluid therethrough and at least the sides are formed from a material having low compressibility whereby when an infant is supported on the pad, the passageways maintain their shape throughout and readily transmit gaseous and liquid fluid therethrough.

The present invention is also directed to an infant's crib adapted to readily promote passive ventilation therethrough comprising in combination a crib frame having a bottom and side railings including slats, a sleeping pad positioned on the crib frame bottom, the pad comprising a support member having a top, a bottom and sides, the support member adapted to resiliently support an infant thereon, a plurality of substantially planar, four sided passageways extending through the support member from the top to the bottom, each one of the passageway sides extends perpendicular to the top and the bottom and abuts against an adjacent one of the passageway sides from the top to the bottom to readily transmit fluid therethrough and at least the passageway sides are formed from a material having sufficiently low compressibility whereby when an infant is supported on the cushion, the passageways substantially maintain their shape throughout and thereby readily transmit gaseous and liquid fluid therethrough and a slat cushion, the slat cushion having a top, a bottom, a first side and a second side, the slat cushion is adapted to allow transmission of respiratory gases therethrough and is affixed against at least one of the crib slats to provide a cushion thereagainst.

The present invention is further directed to bedding adapted to readily promote passive ventilation therethrough comprising a cover adapted to readily enable gas and fluid to pass therethrough and gas transmissive fill material enclosed within said cover.

The present invention is also directed to a cushion for the slats of a crib, the cushion comprising a top, a bottom, a first side and a second side, means for securing the cushion to at least one slat of a crib wherein the cushion is adapted to allow transmission of respiratory gases therethrough.

These and other objects and advantages of the present invention will become apparent from the following description of the preferred embodiment taken together with the accompanying drawings.

BRIEF DESCRIPTION OF THE DRAWINGS

FIG. 12 illustrates a perspective view of the sleeping pad according to the present invention enclosed within an open-weave fabric covering of the present invention; and FIG. 13 illustrates a comforter according to the present invention having an open-weave fabric covering and reticulated foam fill for use with the sleeping pad and bumper pads.

DETAILED DESCRIPTION OF THE PREFERRED EMBODIMENT

Figure 1:
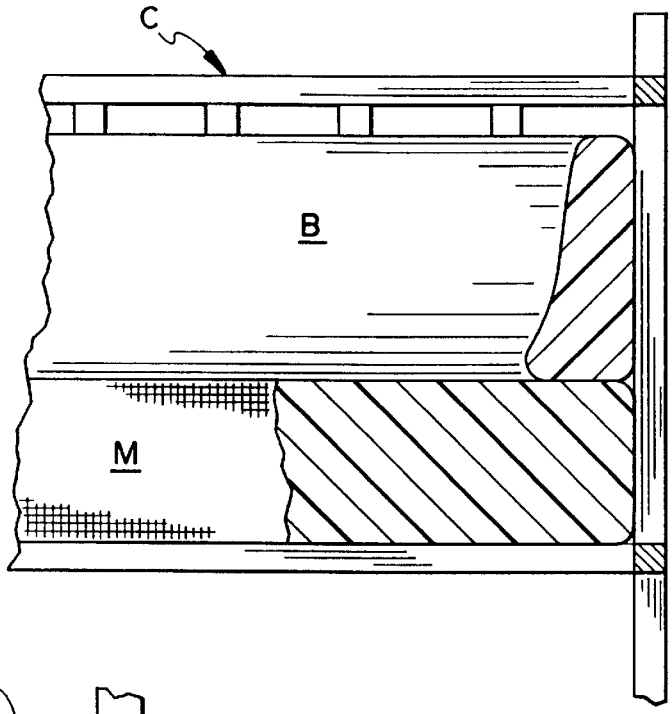
FIG. 1 (PRIOR ART)
FIG. 1 illustrates a prior art mattress pad and bumper shown positioned within a crib with portions broken away.

Turning to FIG. 1, a prior art mattress M and bumper pad B are shown positioned within a crib C. Both the mattress and the bumper pad are constructed from minimally gas and liquid permeable materials. Because the mattress M covers the entire floor of the crib and the bumper B extends a substantial height (usually 9 inches) above the mattress, the two create a relatively closed crib environment having reduced gas circulation therethrough. The expired carbon dioxide is heavier than air and therefore collects within the interior of the crib. Further, the barrier created by the mattress M and bumper B increases heat retention within the crib. In addition, the mattress M and bumper B are minimally liquid permeable so that liquid spit-up by the infant likewise remains within the crib C. When the infant is lying face down, the liquid can collect around the nose and mouth causing interference with breathing.

Figure 3:
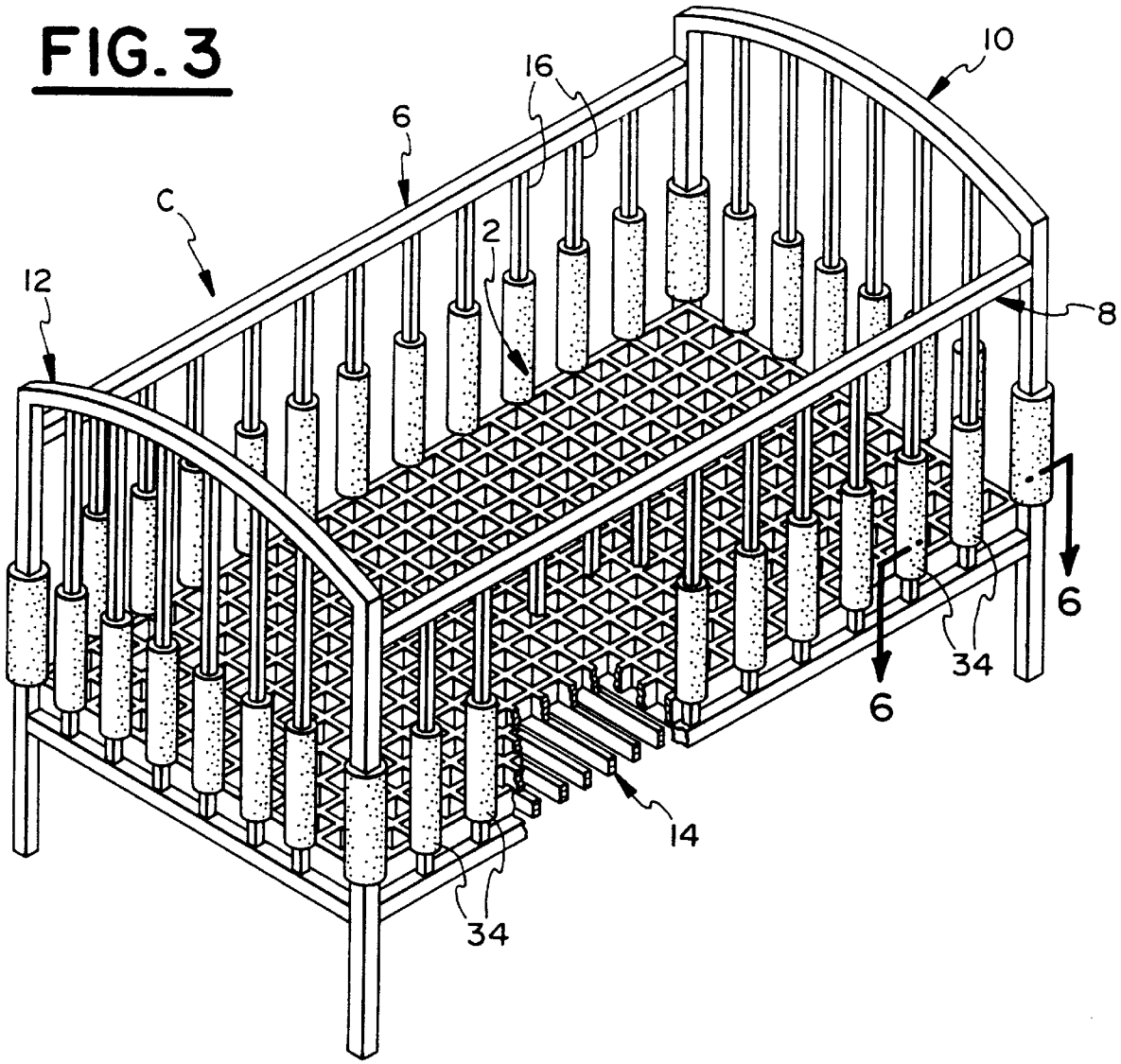
FIG. 3 is a perspective view of the sleeping pad according to the present invention together with an alternative embodiment of the bumpers within a crib and having portions of the sleeping pad broken away to show the underlying mattress support members of the crib.

Turning now to FIG. 3, a crib C is shown provided with a sleeping pad 2 and slat cushion or bumpers 34 according to the present invention. The crib C is of conventional construction and is shown to generally include side rails 6 and 8, headboard 10 and footboard 12. It is within the scope of the present invention to provide a crib having side rails designed to be selectively lowered for the purpose of gaining access to the crib. A pad support 14 is also shown to include a series of parallel trusses extending transverse to the longitudinal axis of the crib C. Each of the side rails 6, 8, headboard 10 and footboard 12 include individual slats 16 extending vertically along the perimeter of the crib C. The sleeping pad 2 according to the present invention is shown having a generally rectangular configuration; however, it is within the scope of the invention to vary the shape in accordance with the crib or playpen design.

Figure 5:
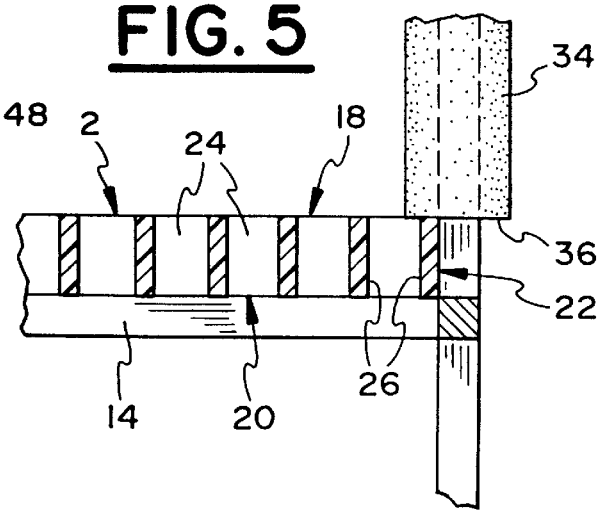
FIG. 5 is an enlarged cross sectional view of a corner portion of the crib shown in FIG. 3 with portions of the crib broken away.
Figure 6:
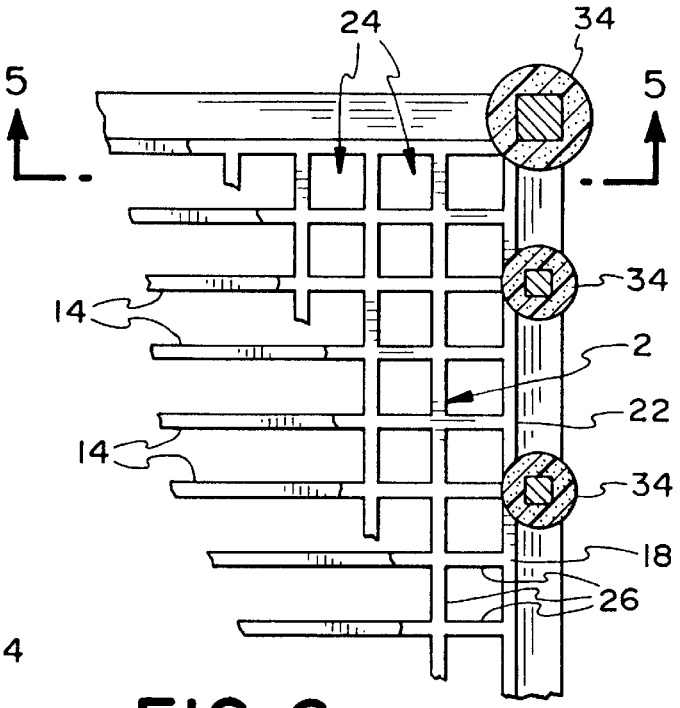
FIG. 6 is an enlarged top plan view of FIG. 3 taken along lines 6—6 with portions of the bumper shown in cross section and the pad shown broken away to expose the underlying mattress support members of the crib.

Turning to FIGS. 5 and 6 the sleeping pad 2 according to the present invention is shown to generally include a top surface 18, bottom surface 20 and sides 22. A series of individual passageways 24 are disposed within the sleeping cushion or pad 2 and each extends from the top 18 to the bottom 20 of the cushion or pad. Each passageway 24 is shown to further include at least four, generally planar, side walls 26 extending from the top 18 to the bottom 20. As can be seen in FIGS. 3 and 6, the numerous passageways 24 create a grid-like configuration within the sleeping pad 2. Each passageway 24 has a generally square cross-section and provides a uniform conduit through which fluids, and especially respiratory gases and liquids, will readily flow.

Planar side walls 26 cooperate to provide a region of continuous surface area within the passageway 24 through which a fluid may be efficiently conveyed. In a preferred embodiment, this fluid is a respiratory gas such as carbon dioxide or, as mentioned earlier, a liquid from the nose and mouth. Because carbon dioxide is heavier than air, it is conveyed downwardly through the sleeping cushion 2 via passageways 24 as the infant breathes. In addition, room air currents that contain fresh oxygen will pass up or down passageways 24 and will provide additional ventilation of the infant's environment.

Figure 7:
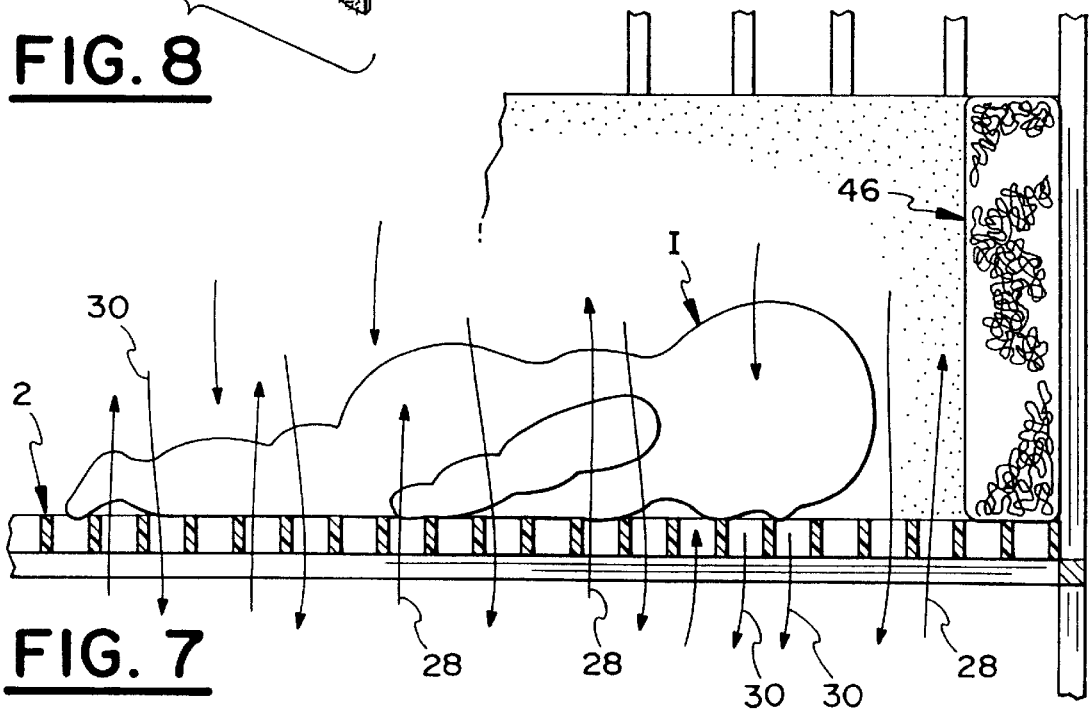
FIG. 7 is a side elevational view of the present invention showing an infant lying face down on the sleeping pad and showing arrows to indicate the flow of respiratory gases therethrough and with portions of the bumper shown in cross section and portions of the crib broken away.

This is best illustrated in FIG. 7 where an infant I is shown positioned face-down on the sleeping pad 2. Arrows 28 indicate the direction of flow of air up or down through the pad 2 and into or out of crib C while expired carbon dioxide passes downwardly through the pad 2 and away from the crib C as shown by arrows 30. Further, should the infant spit-up fluid or other material it can readily pass down through the passageways 24 and away from the crib thereby decreasing the likelihood of interfering with the infant's breathing. A pan (not shown) or other liquid collection means can be positioned beneath the pad to collect any liquid passing therethrough.

In the preferred embodiment, the sleeping cushion or pad 2 has sufficient rigidity to render the pad substantially self-supporting, requiring only conventional crib mattress supports or trusses 14 as shown in FIG. 3 for support. It is within the scope of the present invention to employ a crib having varied means for supporting a mattress. For example, fewer trusses could be employed to support the pad according to the present invention. The sleeping pad 2 must be constructed from a material that during use provides low compressibility (firm) and a smooth surface throughout for enhancing the flow of gases or liquids therethrough. Also, it is preferred that the material be washable. A critical feature of the present invention is that while the material from which the sleeping pad 2 is constructed has low compressibility, side walls 22 of each passageway 24 will not distort under the weight of the infant. In this way, each of the passageways 24 maintains its shape throughout and will readily transmit gaseous and liquid fluids through the passageways during use. This passive fluid transport is accomplished without the need for electrical appliances or complex mechanisms.

In the preferred embodiment of the present invention, sleeping pad 2 has a thickness from about one inch to about two inches; however, a pad thickness outside of this range is operable. The thickness has been determined to yield sufficient structural support while also providing a level of comfort for an infant placed upon the pad 2. Generally speaking, the distance between side walls 26 of adjacent passageways 24 is about one quarter of an inch. However, the distance between sidewalls can vary, depending upon, for example, the sleeping pad construction material. The numerous passageways 24 are economically configured for the physiology of the infants face so that when an infant is face-down on the pad, he or she is comfortably supported and normal breathing will not be interfered with by the pad holes. Each passageway has a width between about three eights inch to about three quarters of an inch. Other widths are contemplated within the scope of the present invention.

In a preferred embodiment, pad 2 is constructed from a foamed polymer material that is both non-toxic and hypoallergenic and washable. A foamed material especially suited for use with the present invention is marketed under the trade name ETHAFOAM® and is manufactured by Dow Plastics of Midland, Mich. ETHAFOAM® is a polyethylene foam having the compressibility characteristics required by the present invention yet also provides the resilient support necessary for the infant's comfort. The physical characteristics of ETHAFOAM® are set forth in Dow Chemical publication form no. 172-1133-290 which is incorporated herein by reference. Most importantly, the planar side walls 26 of each passageway 24 will not distort under the weight of the infant and thus provide a continuous planar surface area through which respiratory gases and liquids will readily pass.

As best shown in FIG. 12, an open-weave fabric covering or fitted sheet 32 may be used in connection with the sleeping pad 2 of the present invention. The open-weave fitted sheet is preferably a fabric of either natural and/or synthetic material and is configured to fit the sleeping pad 2 in a snug manner. The open-weave cover 32 permits carbon dioxide to be passively flushed through the passageways 24 while also allowing oxygenated air to be circulated therethrough. Further, the cover 32 will provide additional comfort for the infant. The open-weave fabric selected for cover 32 is a washable fabric material that will allow not only gas to pass therethrough but also regurgitated liquid such as milk, juice or water and thus assist in keeping fluid from the infants face. This is especially important if the infant is in the face down position on the sleeping pad 2 as shown in FIG. 7.

Returning now to FIGS. 3, 5 and 6 a series of individual bumpers or rail cushions 34 are shown. Each bumper 34 is provided on a separate slat 16 of the crib C and including the corner post. Generally speaking, the bumpers 34 are of cylindrical shape although they may take other shapes such as square. The bumper 34 has a length of about six inches to about nine inches. As best shown in FIG. 5, the bottom surface 36 of an individual bumper 34 rests upon the top surface 18 of the sleeping pad 2. Although the bumper can be made in a variety of lengths to accompany the different slats, in a preferred embodiment the length is about six inches to allow the bumper to slide along the slat if the side of the crib 6,8 is lowered (not shown). Bumpers can be stacked to cover more of the slat surface, for increased safety. In certain situations no bumpers are required. For example, a newborn infant will not generally require that bumpers be added to the crib if the crib mattress support is in its uppermost position. As the infant grows in size and height, the mattress support is gradually lowered and the nine inch bumpers may then be used on each of the slats.

Figure 8:
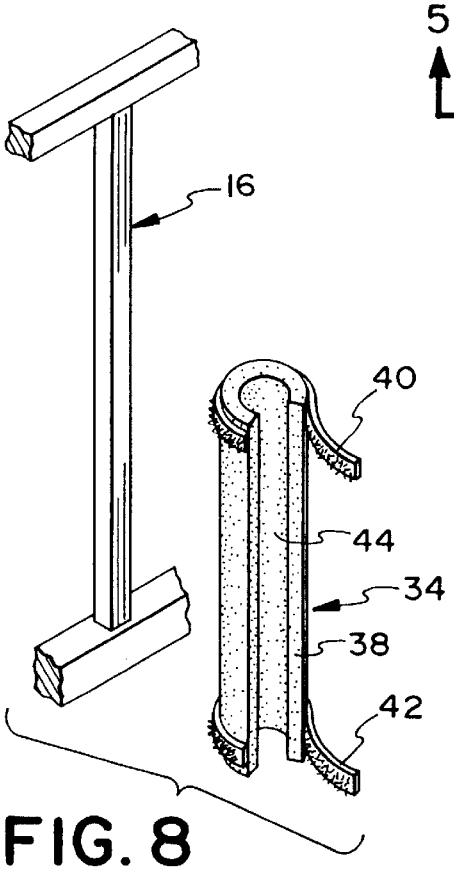
FIG. 8 illustrates an individual bumper according to the present invention including a securing means and in an open position prior to attachment to a crib rail member shown broken away.
Figure 9:
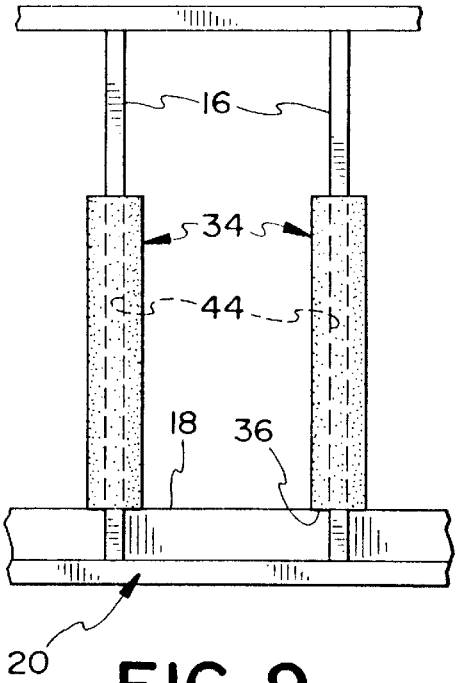
FIG. 9 illustrates bumpers of the present invention shown attached to rail members of the crib.

Turning now to FIGS. 8 and 9 an individual bumper 34 is shown in association with a slat 16 of a crib C. The bumper 34 includes a longitudinal slit or opening 38 extending the length of the bumper to provide a means to accommodate the bumper to a rail 16. Optionally, VELCRO® fasteners 40 and 42 may be provided to provide additional means for attachment to the rail 16. As best shown in FIG. 9, the bumper 34 is attached to the rail 16 and extends central region 44 of the bumper around the exterior of the slat in a manner that forms a protective covering thereover. The VELCRO® fasteners 40,42 may not be required depending upon the type of material selected for construction of the bumper. For example, if the material is provided with elastic memory, the bumper will simply be stretched over to snap fit around the rail without the need for additional fasteners. Also, the bumpers according to the present invention will not injure the infant if they are pried loose within the crib C. Further, when used in conjunction with the sleeping pad 2 of the present invention or with a conventional mattress, the bumpers provide open passageways into the crib that promote the circulation of air and removal of carbon dioxide.

In a preferred embodiment, the bumpers 34 according to the present invention are constructed from reticulated foam that will allow fluid, and especially respiratory gases, to pass therethrough. Unlike conventional foam, reticulated foam is very porous and does not require the provision of supplemental holes or passageways to enable respiratory gases to pass through, as well as between adjacent bumpers, and therefore is preferred for use in construction of the bumper 34 according to the present invention. In the alternative, ETHAFOAM®, although not air permeable, may be used or some other synthetic material can be selected since the bumpers are spaced from each other sufficient to allow gases to pass therebetween. The reticulated foam selected should be nontoxic, hypo-allergenic and normally will not require fasteners to secure the foam to the slat. The reticulated foam bumpers according to the present invention are washable. Material other than reticulated foam is contemplated within the scope of the present invention so long as it allows air or other gases to readily pass therethrough.

Figure 4:
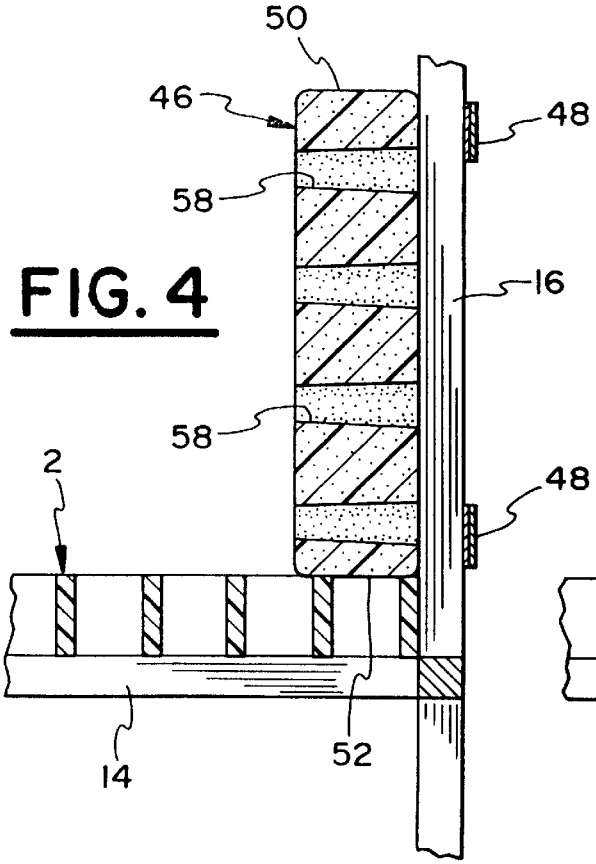
FIG. 4 is an enlarged cross sectional view taken along lines 4—4 of FIG. 2 with portions of the crib shown broken away.
Figure 2:
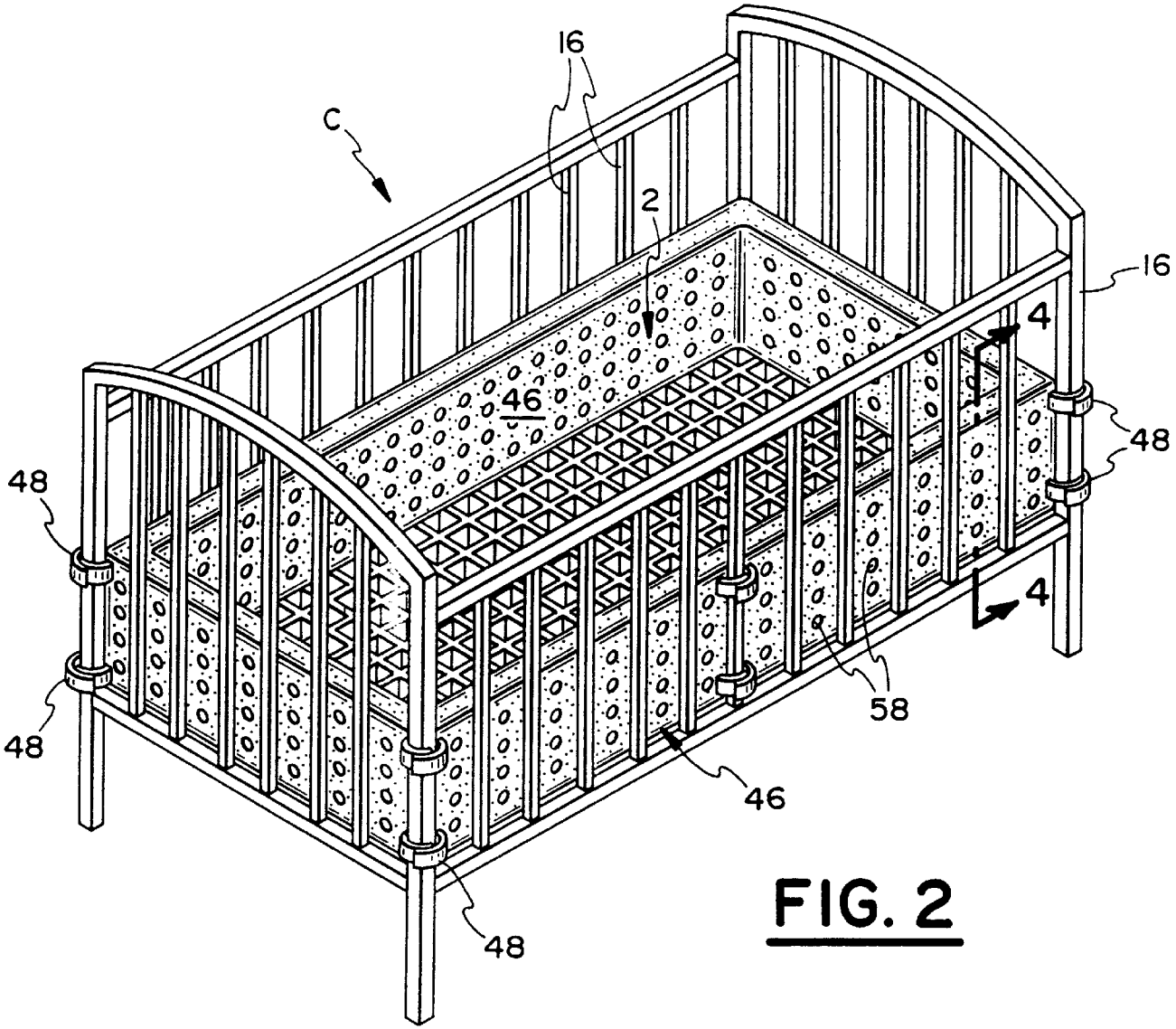
FIG. 2 is a perspective view of the sleeping pad according to the present invention together with a bumper positioned within a crib.

Turning now to FIG. 2, an alternative embodiment of the present invention is shown. The crib C is provided with a sleeping pad 2 as in the previous embodiments but further includes a continuous bumper pad 46 extending along the interior perimeter of the crib C. A series of securing members 48 are provided for attaching the bumper pad 26 to the rail members 16. Turning now to FIG. 4, the bumper pad 46 can be seen in greater detail and includes a top surface 50, a bottom surface 52 and side surfaces 54 and 56. The bottom 52 of the bumper pad 46 is shown lying upon the top of the sleeping pad 2. A series of passageways 58 extend through the bumper pad 46 from side 52 to side 56. The passageways 58 are generally annular in configuration however other shapes are within the scope of the present invention. For example, a square configuration is preferred if larger sized passageways are desired.

As best shown in FIG. 2, passageways 58 are regularly positioned along the entire surface to enable fluids such as respiratory gases to readily pass therethrough. When used in connection with the sleeping pad 2, the bumper pad 46 according to the present invention is a safe and effective means to both protect the infant from injury, in the event he or she strikes a slat, while at the same time allowing oxygenated air to enter and carbon dioxide to leave the crib environment.

Figure 11:
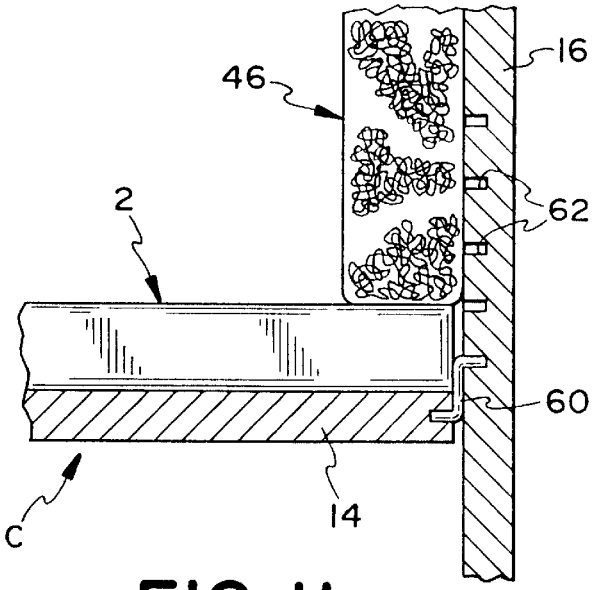
FIG. 11 illustrates an enlarged cross-sectional view of the corner assembly of a crib according to the present invention with the sleeping pad and bumper shown positioned within the crib and including details regarding height adjustment for the crib supports.

In a preferred embodiment, bumper pad 46 has a height between about six to nine inches to enable the pad to slide upwardly along the rail 16 if the side of the crib is lowered (not shown). A nine inch bumper according to the present invention is attached as shown in FIG. 2 and may be readily removed as is done with conventional bumpers. The nine inch length is satisfactory for all pad height positions in the crib. A conventional mattress has about three or four positions of vertical adjustment and only in the uppermost position is it necessary to disconnect the 9-inch bumper when lowering a side of the crib. As shown in FIG. 2, bumper pad 46 may comprise a single length however it is contemplated within the scope of the present invention to provide plural individual sections. For example, a separate section for each side of the crib C may be provided. If the bumper pad is formed from ETHAFOAM®, that embodiment is desirable since ETHAFOAM® is relatively inflexible and a single continuous piece could not be fitted within the inside perimeter of the crib. In an additional preferred embodiment as shown in FIGS. 7 and 11, the bumper pad 46 is constructed from reticulated foam. In this embodiment no slots or passageways are required since the reticulated foam allows gas to readily pass therethrough.

Figure 10:
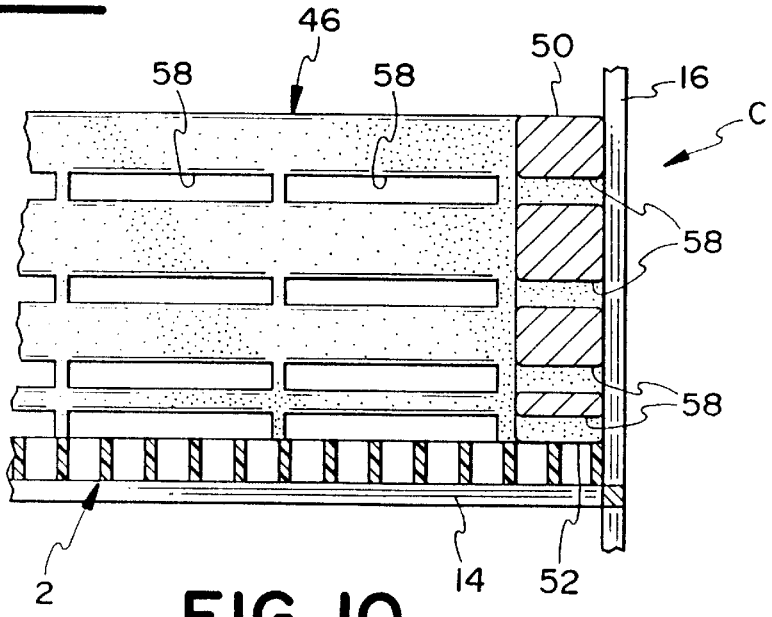
FIG. 10 illustrates an alternative embodiment of the bumper shown in FIG. 4.

Turning now to FIG. 10, an alternative embodiment of bumper pad 46 is shown whereby the passageways are configured as longitudinal slots 60 extending parallel to the longitudinal axis of the bumper pad 46. It is within the scope of the present invention to variously arrange the slots along the length of the pad 46. For example, slots can be provided along the bottom surface of the pad where it rests against the cushion or pad 2 to passively blow away carbon dioxide accumulating on the pad 2, by means of room air currents.

Turning now to FIG. 11, detail is shown regarding adjustment for the height of pad 2 when used in a crib C. Adjustment member 60 is adapted to secure the support 14 at a predetermined height by fitting the member 60 within a desired slot 62 extending within the crib rail 16. Mattress support 14 may be readily raised or lowered to a different position. Pad 2 will be raised or lowered with the support 14 as will bumper pad 46 resting thereon. In this way, the bumper pad 46 as well as the sleeping pad 2 are fully adapted to be adjusted to the desired height.

Turning to FIG. 13, a further embodiment of the present invention is shown with respect to a comforter 64 or similar bedding material for use in combination with the sleeping pad 2 and bumper pad 46 or bumpers 34. The comforter 64 contains a reticulated foam fill material and is covered with an open-weave covering of, e.g., cotton and polyester, that is gas and liquid permeable and washable. Conventional prior art comforters use closed weave fabric and non-porous fill material which prevents gas and liquid from passing therethrough. The pore size of the reticulated filler used in the comforter of the present invention is preferability similar to that provided for bumper pad 46 discussed above. The comforter 64 will have a thickness similar to that of a conventional comforter. When the reticulated filler comforter is used in connection with the sleeping cushion or pad 2 and bumper pad 46 or bumpers 34, the crib environment is rendered substantially permeable to gas and especially with respect to carbon dioxide. In this way, the infant in the crib is provided with an environment that will allow oxygenated air to reach the interior of the crib, while carbon dioxide and liquids are removed. In addition, the infant is kept reasonably comfortable and warm while avoiding the problems of overheating. Finally, if the comforter according to the present invention is accidentally positioned over the infant's head, the infant may survive due to the gas permeability of the comforter and sleeping pad. In yet a further embodiment of the present invention, a pillow for the crib could be provided having the above mentioned open-weave cover and reticulated foam filler. If an infant is lying face down on this reticulated foam pillow, there may be less risk of death because expired carbon dioxide entering the pillow can be dispensed through the fill rather than forming a pocket of carbon dioxide for rebreathing as in conventional prior art pillows.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

What is claimed is:

1. A sleeping pad for use in an infants crib to promote passive ventilation of respiratory gases and fluids therefrom comprising:

a) a pad member configured for direct support upon floor slats of a crib, said pad member having a top, a bottom and sides, and adapted to resiliently support an infant thereon;

b) a plurality of substantially planar, four sided passageways extending through said pad member from said top to said bottom, each one of said passageway sides extends perpendicular to said top and said bottom and abuts against an adjacent one of said passageway sides from said top to said bottom to directly transmit gaseous and liquid fluid therethrough and in a direction from said top to said bottom; and c) at least said passageway sides are formed from a foam material having low compressibility whereby when an infant is supported on said pad member, said passageways sides retain their shape throughout and readily transmit gaseous and liquid fluid therethrough and away from the crib in an unrestricted manner.

2. A sleeping pad as in claim 1 and wherein:

a) said material is a polyethylene foam.

3. A sleeping pad as in claim 1 and wherein:

a) each of said passageways has a substantially square cross-sectional configuration.

4. A sleeping pad as in claim 1 and further including:

a) an open-weave fabric pad cover, said cover configured to receive said pad member and enclose the same.

5. A sleeping pad member has a thickness between about one inch to about three inches.

6. A sleeping pad as in claim 1 and wherein:

a) said plurality of passageways are spaced apart a distance of about one quarter of an inch.

7. A sleeping pad as in claim 1 and wherein:

a) said plurality of passageways extend across said cushion in a grid-like configuration.

8. An infant's crib adapted to readily promote passive ventilation therethrough comprising in combination:

a) a crib frame having a bottom and side railings including floor slats and railing slats;

b) a sleeping pad positioned on said crib frame bottom, said pad comprising a pad member configured for direct support upon floor slats of a crib, said pad member having a top, a bottom and sides, and adapted to resiliently support an infant thereon; a plurality of substantially planar, four sided passageways extending through said pad member from said top to said bottom, each one of said passageway sides extends perpendicular to said top and said bottom and abuts against an adjacent one of said passageway sides from said top to said bottom to directly transmit gaseous and liquid fluid therethrough and in a direction from said top to said bottom; and at least said passageway sides are formed from a foam material having low compressibility whereby when an infant is supported on said pad member, said passageways sides retain their shape throughout and readily transmit gaseous and liquid fluid therethrough and away from the crib in an unrestricted manner; and c) a slat cushion, said slat cushion having a top, a bottom, first side, second side and means for securing said slat cushion to at least one slat of said crib, said slat cushion is adapted to allow transmission of respiratory gases therethrough.

9. An infants crib as in claim 8 and wherein:

a ) said slat cushion is a rectangular pad extending about the perimeter of said crib.

10. An infants crib as in claim 8 and further comprising:

a) at least one passageway extending through said slat cushion from said first side to said second side to readily promote the transmission of respiratory gases therethrough.

11. An infants crib as in claim 10 and wherein:

a) said at least one passageway comprising a longitudinal slot extending the length of said slat cushion and parallel therewith.

12. An infants crib as in claim 10 and wherein:

a) said at least one passageway has an annular configuration.

13. An infants crib as in claim 8 and wherein:

a) said slat cushion is constructed from reticulated foam.

14. An infants crib as in claim 10 and wherein:

a) said slat cushion is constructed from polyethylene foam.

15. An infants crib as in claim 8 and wherein:

a) said slat cushion is a cylindrical pad configured to receive therein said at least one of said crib slats and surround the same.

16. An infants crib as in claim 8 and wherein:

a) said slat cushion is a length of square shaped pad adapted to attach and envelope said at least one of said crib rails.

17. An infants crib as in claim 8 and wherein:

a) said slat cushion includes a plurality of individual cushions each of which is adapted to attach and envelope a separate one of said slats of said side railings.

* * * * *